United States Patent [19]

Deforeit

[11] 4,397,209

[45] Aug. 9, 1983

[54] METHOD OF DETERMINING CHORD TYPE AND ROOT IN A CHROMATICALLY TUNED ELECTRONIC MUSICAL INSTRUMENT

[75] Inventor: Christian J. Deforeit, Trossingen, Fed. Rep. of Germany

[73] Assignee: Matth. Hohner AG, Trossingen, Fed. Rep. of Germany

[21] Appl. No.: 275,986

[22] Filed: Jun. 22, 1981

[30] Foreign Application Priority Data

Jun. 24, 1980 [DE] Fed. Rep. of Germany ..... 3023578

[51] Int. Cl.[3] ..... G10F 1/00

[52] U.S. Cl. ..... 84/1.03; 84/DIG. 22

[58] Field of Search ..... 84/1.01, 1.03, DIG. 22

[56] References Cited

U.S. PATENT DOCUMENTS 4,142,433 3/1979 Gross ..... 84/1.03

4,282,786 8/1981 Deutsch et al. ..... 84/1.03 X 4,295,402 10/1981 Deutsch et al. ..... 84/1.03

*Primary Examiner*—B. Dobeck

*Assistant Examiner*—Forester W. Isen

[57] ABSTRACT

The type and root of a chord played on a chromatically tuned musical instrument are determined by assigning sequential numerical values to the notes of the chromatic scale and, when a chord is played, calculating the intervals between the individual notes comprising the chord arranged in numerical order. In a preferred embodiment the smallest interval and the interval immediately following the smallest interval are compared with prerecorded interval values commensurate with all defined chord types to identify the type of chord played. The recorded information also contains a root value for each defined chord and these root values are employed, along with the starting note of the smallest interval, to determine chord root.

11 Claims, 1 Drawing Figure

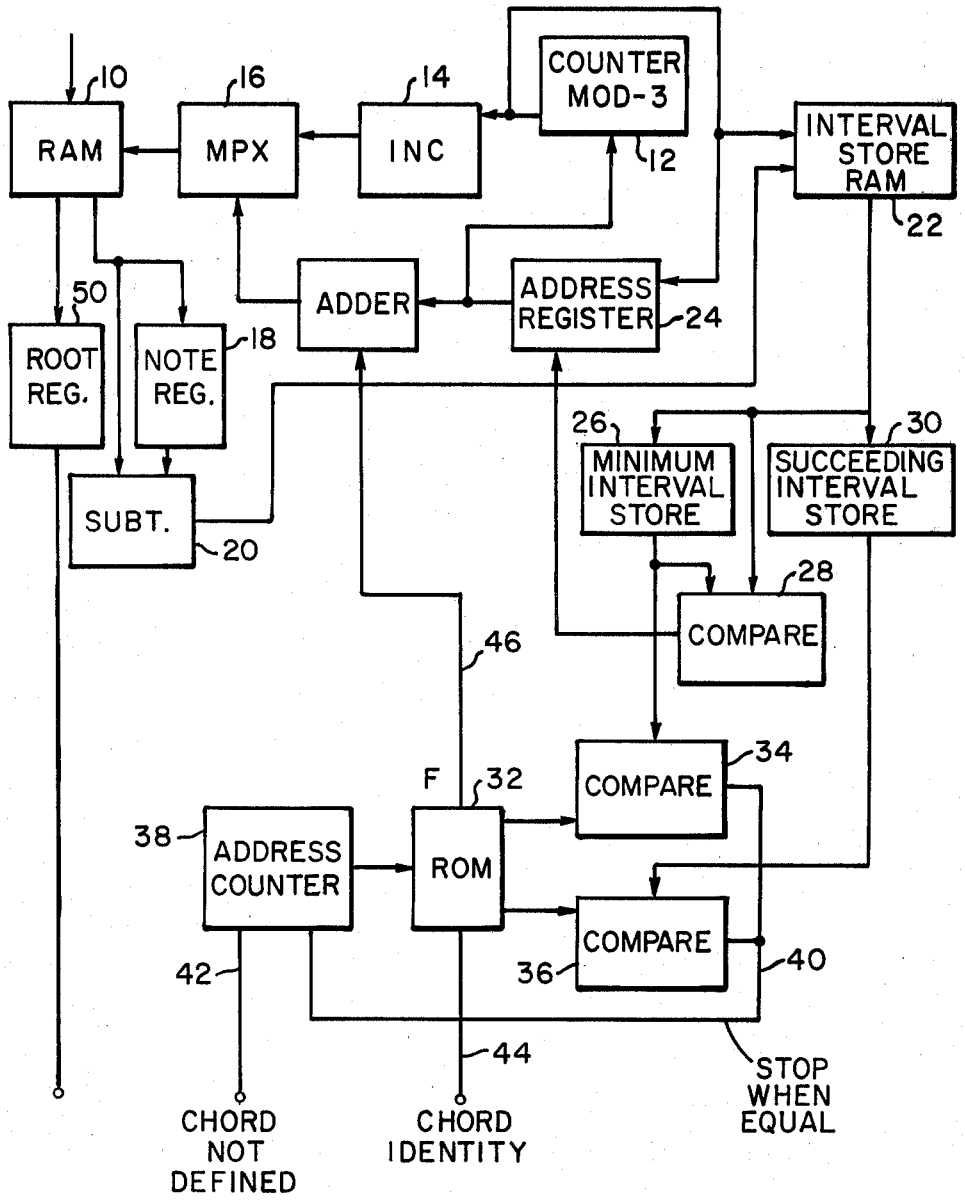
10
RAM
16
MPX
14
INC
COUNTER MOD-3
12
INTERVAL STORE RAM
22
50
ROOT REG.
NOTE REG.
18
ADDER
ADDRESS REGISTER
24
SUBT.
20
26
MINIMUM INTERVAL STORE
30
SUCCEEDING INTERVAL STORE
28
COMPARE
46
F
32
COMPARE
34
38
ADDRESS COUNTER
ROM
COMPARE
36
40
42
44
STOP WHEN EQUAL
CHORD NOT DEFINED
CHORD IDENTITY

METHOD OF DETERMINING CHORD TYPE AND ROOT IN A CHROMATICALLY TUNED ELECTRONIC MUSICAL INSTRUMENT

BACKGROUND OF THE INVENTION (1) Field of the Invention

The present invention relates to a method of determining the type and root of a chord, comprising at least two and at most four notes, which is played on a musical instrument, particularly an electronic keyboard type instrument. More specifically, this invention is directed to logic circuitry for analyizing chords played on a keyboard instrument and producing a digitally coded output signal from which the appropriate sound may be synthesized. Accordingly, the general objects of the present invention are to provide novel and improved methods and apparatus of such character.

(2) Description of the Prior Art

The determination of the type and root of a chord comprising two to four notes, played on a chromatically tuned electronic keyboard instrument, is required in order to, by way of example only, produce an automatic accompaniment to a melody "voice" simultaneously played on the instrument. It has been prior art practice to convert all chords which were played into digital data and to employ the thus produced data to address a read-only memory in which all possible chord types and roots were stored. Thus, in a typical prior art electronic organ, if the chord C-E flat was played, the memory would be addressed with the coded information "minor chord with root C." While this is an operable approach to the synthesis of sound corresponding to keyboard manipulation, it is also an unwieldy approach since the identification method necessitates a very substantial memory capacity. The requirement of a large memory for chord identification is an obvious disadvantage from the standpoint of equipment complexity and cost.

SUMMARY OF THE INVENTION

The present invention overcomes the above-briefly discussed and other deficiencies and disadvantages by providing a novel and improved method of determining the type and root of a chord comprising at least two and at most four notes played on a chromatically tuned electronic musical instrument. The present invention also encompasses apparatus for use in the performance of the aforesaid novel method, the apparatus of the present invention being in part characterized by a substantially reduced memory capacity when compared to the prior art.

The present invention is based upon the fact that, in accordance with western music, only a limited number of chord types are regarded as defined. Since the desired chord types are established by the intervals between the notes which form the chord, independently of their particular position in the scale, these defined chords are found in all keys independently of the particular root involved. In accordance with the present invention, the intervals between the notes which form the chord are ascertained and only those combinations of intervals which are commensurate with a definite chord are employed to address a read-only memory in which data corresponding to such definite chords is stored. Simultaneously, the intervals between the notes which form the chord are employed to produce a characteristic digit which identifies the root of the chord.

Apparatus in accordance with the present invention comprises a read-only memory in which chord types and associated interval combinations are stored. The apparatus, in accordance with a preferred embodiment, further comprises logic circuitry for determining the smallest interval of a chord which has been played and the value of the interval following the smallest interval. These two interval values are temporarily stored and compared with the interval information in the read-only memory whereby the chord type is identified. Upon identification of the chord type, a characteristic code is supplied to the synthesizer of the instrument and a further coded output is produced from which the chord root is determined.

DESCRIPTION OF THE DRAWING

The present invention may be better understood and its numerous objects and advantages will become apparent to those skilled in the art by reference to the accompanying drawing which is a functional block diagram of a preferred embodiment.

DESCRIPTION OF THE PREFERRED EMBODIMENT

Before describing the apparatus illustrated in the drawing, in the interest of facilitating understanding of the invention, the problem and its solution will be further discussed.

If numerical values are associated with the frequencies, i.e., the notes, $N_X$, $N_{X+1}$, - - - $N_{X+11}$ on the chromatic scale, the following table is obtained:

TABLE I

| C, | C sharp, | D, | D sharp, | E, | F, | F sharp, | G, | G sharp, | A, | A sharp, | B, | C |
|---|---|---|---|---|---|---|---|---|---|---|---|---|
| 0 | 1 | 2 | 3 | 4 | 5 | 6 | 7 | 8 | 9 | 10 | 11 | 0 |

It may be seen that the intervals between the notes may be defined, with modulo 12, as differences between the assigned numerical values. Thus, the interval A-C may be given value 3, the interval A sharp—D will likewise have numerical value 4, and so on. It is immaterial whether the notes played are present in only one or in several octaves in order to enable determination of the interval values of interest in accordance with the present invention. There are, of course, two interval values for two note chords, three values for three note chords and four values for four note chords. Thus, by way of example, the two note chord C-E has the interval values 4 and 8 respectively corresponding to the chord or interval C-E and the chord or interval E-C. The four note chord C-E-G-A is defined by the interval values 4-3-2-3. The smallest interval of this four note chord, i.e., 2, is the interval G-A and the two following intervals in the chord (mid-modulo 12) would be—3-4, i.e., the note intervals A–C and C–E. Since the "starting note" of the minimum interval is G, and this minimum interval digit F is 1, the note A is the root of the chord which is a minor seventh chord. The digit F is an offset used to determine the chord root by counting successive stored notes of a played chord. The fourth interval need not be employed in determining chord type since, with modulo 12, use of the fourth interval values produces an over-determination, i.e., because $D_1+D_2+D_3+D_4$ must equal 12, the minimum interval is always taken as the premise or base. However, it can be shown that the maximum interval could alternatively be taken as the base, in which case a smoothly equivalent table would result because only eighteen interval combinations may be obtained for the eight basic defined chord types and the eleven half-tones of the chromatically tuned instrument. It should also be noted that equivalent tables could also be established for non-chromatic instruments such as are used in oriental or east-Asian music.

Continuing with the above discussion, the tabulated chord information for the interval values associated with definite chords, employing the minimum interval as the base, are as follows:

TABLE II

| $D_1$ | $D_2$ | $D_3$ | F | Chord Type |
|---|---|---|---|---|
| 1 | 4 | 3 | 1 | seventh |
| 1 | 3 | | 1 | minor +7 |
| 2 | | | 1 | |
| 2 | 4 | | 1 | |
| 2 | 7 | | 1 | dominant seventh |
| 2 | 4 | 3 | 1 | |
| 2 | 2 | | 0 | seventh with sharp five |
| 2 | 2 | 2 | 2 | |
| 2 | 3 | 3 | 1 | half diminished seventh |
| 2 | 4 | 2 | 1 | seventh with flat five |
| 2 | 3 | | 1 | minor seventh |
| 2 | 3 | 4 | 1 | |
| 2 | 6 | | 2 | diminished |
| 3 | | | 0 | minor chord |
| 3 | 4 | | 0 | |
| 4 | | | 0 | |
| 5 | | | 1 | major chord |
| 3 | 5 | | 2 | |
| 4 | 4 | | 0 | augmented |
| 6 | | | 0 | |
| 3 | 3 | | 0 | diminished seventh |
| 3 | 3 | 3 | 0 | |

With reference now to the drawing, a functional block diagram of circuitry in accordance with a preferred embodiment of the present invention is depicted. It is to be noted that the disclosed circuit will be described in connection with the analysis, for subsequent synthesis, of three-note chords. Those circuit modifications required to conduct evaluation of two and four-note chords will subsequently be briefly explained.

A random access memory 10 functions as a note memory which, in the example being described, will have three memory locations in which may be stored the numerical value associated with the half tones of an octave. These numerical values may, for example, be in accordance with the relationships set forth above in TABLE I wherein C is represented as 0, C sharp as 1, etc. The numerical values of the three-note chord played on the instrument are read into memory 10 by means of coding circuits, which do not comprise part of the present invention, responsive to the conditions of the contacts closed when the keys of the instrument are depressed.

The first function of the circuit shown in the drawing is to ascertain the intervals between the three notes $N_A$, $N_B$ and $N_C$. For this purpose a modulo 3 counter 12 is provided. Counter 12 has its output connected to an incrementing circuit 14 which, via multiplexer 16, addresses RAM 10. Incrementing circuit 14 causes the note memory 10 to be addressed to two successive memory locations in response to a change of state of counter 12. The numerical value stored at the two successive memory locations of RAM 10 which are addressed by the incrementing circuit 14 are loaded into successive registers of a note register 18. Subsequent of the two step addressing of memory 10, the numerical value at the second addressed memory location will be applied as a first input to a subtraction circuit 20 while the numerical value at the first addressed memory location will appear at the output of the note register 18 and thus will be applied as a second input to subtraction circuit 20. Subtraction circuit 20 will, accordingly, provide an output commensurate with the difference between the numerical values at the two addressed locations in the note memory. This numerical difference will be transmitted to and stored in an interval store random access memory 22. The addressing of memory 22 is also under the control of the output of the modulo 3 counter 12.

The above-described operation is repeated for the three pair of notes comprising the chord whereby three modulo 12 intervals, the smallest of which and the succeeding interval must be determined, will be stored at successive memory locations of the interval store RAM 22.

The minimum interval is determined by an address register 24, a "minimum store" register 26 and a comparator 28. At the commencement of the minimum interval determination cycle, the minimum store register 26 will be set at a value which is greater than the largest possible interval, i.e., at a value greater than 11. A first interval value is then called from RAM 22 and, by means of comparator 28, compared with this preset interval value. The interval value read from RAM 22 will necessarily be smaller than the preset interval value. Each time the interval value read from RAM 22 is smaller than the value already present in register 26, the value in register 26 is replaced by the value read from RAM 22 and the memory location address in RAM 22 where the new value stored in register 26 is located will be loaded into address register 24. The foregoing operation is under the control of counter 12 and is performed repetitively with interval values being successively read from RAM 22 and compared with the actual interval value previously read from memory 22. At the end of the third cycle the minimum interval will be stored in register 26 and its associated address in RAM 22 will be stored in address register 24.

Once the minimum interval has been determined and stored, the address of the minimum interval is read from register 24 into counter 12 and counter 12 is subsequently caused to advance by one address (memory location) so that it now delivers to RAM 22 the address of the interval which follows the minimum interval in the chord. It is to be noted that, in the three note chord example being described, the third interval is not required by reason of the fact that this information would amount to over-definition. In other words, as may be seen from the information set forth above in TABLE II, the eight defined types of chords may be identified by the minimum interval, succeeding interval and root. Accordingly, upon the addressing of RAM 22, the interval value of the interval succeeding the minimum interval will be read into a register 30. Accordingly, there will now be present in the registers 26 and 30 two numerical values from which the chord type may be determined by reference to TABLE II. The registers 26 and 30 may comprise random access storage devices.

Referring again to the information set forth above in TABLE II, with three notes and therefore the need to evaluate two intervals, there are only twelve combinations which lead to a "defined" chord type, i.e., a combination of one of the eight defined chords and eleven half tones of a chromatically tuned instrument. The contents of registers 26 and 30 are respectively delivered to first inputs of comparators 34 and 36. The second inputs to these comparators are derived from a read-only memory 32 in which the data presented above in TABLE II has been stored. The addressing of ROM 32 is under the control of an address counter 38. Accordingly, the "defined" interval combinations are taken in sequence from ROM 32, delivered to comparators 34 and 36 and compared with the interval values of the minimum interval and the interval immediately following the minimum interval. When both of comparators 34 and 36 establish equality, a "stop" signal will appear on conductor 40 and be applied to address counter 38. Otherwise, with each successive addressing of ROM 32, a "chord not defined" signal will be applied at output 42 of address counter 38 and delivered to the control logic of the instrument. When a defined chord is detected, as indicated by the appearance of a "stop" signal on conductor 40, the identification of this chord is immediately transmitted by ROM 32 to the synthesizer via conductor 44. Simultaneously, a signal commensurate with the characteristic digit F of the identified chord, is applied to conductor 46. This numerical value is added, by an addition circuit 48, to the number commensurate with the address of the minimum interval as then stored in address register 24, naturally with modulo 3, and the output of addition circuit 48 is, via multiplexer 16, used as an address for the desired root. That is, the output of addition circuit 48 will become a new address for RAM 10 and the numerical value commensurate with the root will then be written into a root register 50. The tone or note $N_{X+F}$ on which the chord is built, i.e., the chord root, is the root of the chord in which $D_1 = N_{X+1} - N_X$. The output of addition circuit 48 is the number $N_{X+F}$. Thus the output of addition circuit 48 will cause RAM 10 to be advanced a number of memory locations, from the "starting note" of the minimum interval, determined by the stored value F.

The above-described operation of the preferred embodiment of the present invention is under the control of a logic circuit which is started externally and blocks new inputs until the above-described processing cycles have been completed. The logic circuit, and particularly the control of counter 12, is within the skill of those versed in the art.

It will now also be within the ability of those skilled in the art to undertake modifications of the disclosed embodiment in order to enable the examination of chords comprising two or four notes. This may be accomplished merely by replacing all circuits which operate with modulo 3 by those with either modulo 2 or modulo 4. This may be accomplished automatically when it is found that, at the input to the circuit, a chord is present which is comprised of two or four notes.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A method of determining the type and root of a chord played on a chromatically tuned musical instrument and comprising at least three notes, said method including the steps of:

assigning sequential numerical note values to the notes of the chromatic scale;

determining and storing said note values which correspond to the notes of an actually played chord;

determining the intervals between successive adjacent pairs of notes of said actually played chord;

selecting the smallest of the determined intervals and at least the determined interval immediately succeeding the smallest determined interval;

comparing the selected intervals with tabulated interval information stored in a table corresponding to defined chord types to identify the chord; and determining the chord root by sequentially counting from the stored note which started the smallest interval by a number of stored notes as defined by a characteristic digit from said table commensurate with the identified chord.

2. A method of determining the type and root of a chord played on a chromatically tuned musical instrument and comprising at least three notes, said method including the steps of:

assigning sequential numerical note values to the notes of the chromatic scale;

determining and storing said note values which correspond to the notes of an actually played chord;

determining the interval between successive adjacent pairs of notes of said actually played chord;

selecting the largest of the determined intervals and at least the determined interval immediately adjacent to the largest determined interval;

comparing the selected intervals with tabulated interval information stored in a table corresponding to defined chord types to identify the chord; and determining the chord root by sequentially counting from the stored note which started the largest interval by a number of stored notes as defined by a characteristic digit from said table commensurate with the identified chord.

3. The method of claims 1 or 2 wherein the step of determining intervals comprises:

comparing the stored numerical values of the notes to obtain the difference between the values of each pair of notes, the comparisons being made between the stored values taken in numeric order.

4. Apparatus for determining the identity and root of a chord to be electronically reproduced by a chromatically tuned musical instrument comprising:

first storage means, said first storage means having stored therein interval combinations commensurate with defined chord types and root digit information for each such interval combination;

note storage means for storing information commensurate with sequentially assigned numerical values associated with the notes of the chromatic scale, said note storage means receiving the numerical values of the notes of a chord played on the instrument;

means connected to said note storage means for determining the differences between the numerical values of pairs of the notes comprising the chord, the notes comprising each pair being in numerical sequence, said difference determining means generating interval signals commensurate with each determined difference;

interval storage means connected to said difference determining means for storing each of said interval signals at a different memory location;

first comparator means for comparing the stored interval signals to one another to determine the smallest interval and its memory location address in said interval storage means said first comparator means also generating and storing signals commensurate with the smallest interval and the address in said interval storage means of said smallest interval;

means connected to said first comparator means and responsive to the stored address of said smallest interval for causing said interval storage means to provide an output signal commensurate with the stored interval signal of the interval determined immediately following the determined smallest interval;

second storage means connected to said interval storage means for storing said signal commensurate with said interval following said smallest interval;

second comparator means connected to said first comparator means and said first and second storage means for comparing said signals commensurate with said smallest and following intervals with the interval combinations stored in said storage means, said second comparator means providing a coincidence output commensurate with the detection in said first storage means of a chord corresponding to the chord played;

means responsive to a coincidence output provided by said second comparator means for reading signals commensurate with chord type and the stored root digit information of the chord from said first storage means; and means responsive to the said root digit information and to the stored address of said smallest interval for reading the chord root note from said note storage means.

5. The apparatus of claim 4 wherein said difference determining means and said interval storage means are operated in sequence under the control of an address counter.

6. The apparatus of claim 5 wherein said means for reading the chord root from said note storage means includes means for adding the root digit information to the address of the starting note of the smallest interval.

7. The apparatus of claim 6 wherein said address counter and adding means comprise modulo-n circuits for a chord having n notes.

8. The apparatus of claim 4 wherein said second comparator means includes:

an address counter for addressing said first storage means; and means responsive to a lack of equality between the interval combinations stored in said first storage means and the smallest and following interval values for changing the address provided by said address counter, a change in address indicating a non-defined chord.

9. The apparatus of claim 8 wherein said difference determining means and said interval storage means are operated in sequence under the control of a second address counter.

10. The apparatus of claim 9 wherein said means for reading the chord root from said note storage means includes means for adding the root digit information to the address of the starting note of the smallest interval.

11. The apparatus of claim 10 wherein said second address counter and adding means comprise modulo-n circuits for a chord having n notes.

* * * * *